US007718332B2

(12) United States Patent
Wu et al.

(10) Patent No.: US 7,718,332 B2
(45) **Date of Patent: *May 18, 2010**

(54) TITANYL PHTHALOCYANINE SILANOL PHOTOCONDUCTORS

(75) Inventors: Jin Wu, Webster, NY (US); Michael A. Morgan, Fairport, NY (US); Anthony M. Horgan, Pittsford, NY (US); Liang-Bih Lin, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 931 days.

This patent is subject to a terminal disclaimer.

(21) Appl. No.: 11/512,779

(22) Filed: Aug. 30, 2006

(65) Prior Publication Data

US 2008/0057422 A1 Mar. 6, 2008

(51) Int. Cl.
*G03G 5/047* (2006.01)

(52) U.S. Cl. ..... 430/58.2; 430/58.8; 430/59.5; 430/59.1

(58) Field of Classification Search ..... 430/58.2, 430/58.8, 59.1, 970, 59.5
See application file for complete search history.

(56) References Cited

U.S. PATENT DOCUMENTS

| | | | | |
|---|---|---|---|---|
| 4,265,990 | A | 5/1981 | Stolka et al. | |
| 4,921,769 | A | 5/1990 | Yuh et al. | |
| 5,153,094 | A | 10/1992 | Kazmaier et al. | |
| 5,166,339 | A | 11/1992 | Duff et al. | |
| 5,189,155 | A | 2/1993 | Mayo et al. | |
| 5,189,156 | A | 2/1993 | Mayo et al. | |
| 5,905,008 | A * | 5/1999 | Yoshinaga et al. | 430/58.2 |
| 6,376,141 | B1 | 4/2002 | Mishra et al. | |
| 6,713,220 | B2 | 3/2004 | Graham et al. | |
| 6,913,863 | B2 | 7/2005 | Wu et al. | |
| 7,037,631 | B2 | 5/2006 | Wu et al. | |
| 7,541,122 | B2 * | 6/2009 | Wu et al. | 430/58.2 |
| 7,560,206 | B2 * | 7/2009 | Wu et al. | 430/58.8 |
| 2006/0105254 | A1 * | 5/2006 | Wu et al. | 430/59.5 |
| 2008/0014516 | A1 * | 1/2008 | Wu et al. | 430/58.2 |
| 2008/0014517 | A1 * | 1/2008 | Wu et al. | 430/58.2 |

FOREIGN PATENT DOCUMENTS

JP 07168381 A * 7/1995

OTHER PUBLICATIONS

English language machine translation of JP 07-168381 (Jul. 1995).*
ChemDraw Structure of dicyclohexylsilanol (2009).*
Jin Wu et al., U.S. Appl. No. 11/472,765 on Titanyl Phthalocyanine Photoconductors, filed Jun. 22, 2006.
Jin Wu et al., U.S. Appl. No. 11/472,766 on Titanyl Phthalocyanine Photoconductors, filed Jun. 22, 2006.

* cited by examiner

*Primary Examiner*—Christopher RoDee
(74) *Attorney, Agent, or Firm*—E. O. Palazzo

(57) ABSTRACT

A photoconductor containing an optional supporting substrate; a photogenerating layer comprised of a chelating agent and a titanyl phthalocyanine; and at least one charge transport layer comprised of at least one charge transport component, and wherein a silanol is present in at least one of said photogenerating layer and charge transport layer.

32 Claims, 2 Drawing Sheets

TITANYL PHTHALOCYANINE SILANOL PHOTOCONDUCTORS

CROSS REFERENCES

U.S. application Ser. No. 11/512,841, U.S. Publication No. 20080057428, filed Aug. 30, 2006, the disclosure of which is totally incorporated herein by reference, on Titanyl Phthalocyanine Photoconductors by Jin Wu et al.

U.S. application Ser. No. 11/512,838, U.S. Publication No. 20080057423, filed Aug. 30, 2006, the disclosure of which is totally incorporated herein by reference, on Titanyl Phthalocyanine Silanol Terphenyl Photoconductors by Jin Wu et al.

U.S. application Ser. No. 11/512,815, U.S. Pat. No. 7,618, 758, filed Aug. 30, 2006, the disclosure of which is totally incorporated herein by reference, on Silanol Containing Perylene Photoconductors by Jin Wu et al.

U.S. application Ser. No. 11/512,778, U.S. Publication No. 20080057421, filed Aug. 30, 2006, the disclosure of which is totally incorporated herein by reference, on Silanol Containing Perylene Photoconductors by Jin Wu et al.

In U.S. Pat. No. 7,553,593, and U.S. Pat. No. 7,485,398, the disclosures of which are totally incorporated herein by reference, there is disclosed, for example, photoconductors comprising a photogenerating layer and a charge transport layer, and wherein the photogenerating layer contains a titanyl phthalocyanine prepared by dissolving a Type I titanyl phthalocyanine in a solution comprising a trihaloacetic acid and an alkylene halide; adding the mixture comprising the dissolved Type I titanyl phthalocyanine to a solution comprising an alcohol and an alkylene halide thereby precipitating a Type Y titanyl phthalocyanine; and treating the Type Y titanyl phthalocyanine with a monohalobenzene.

High photosensitivity titanyl phthalocyanines are illustrated in copending U.S. application Ser. No. 10/992,500, U.S. Publication No. 20060105254, the disclosures of which are totally incorporated herein by reference, which, for example, discloses a process for the preparation of a Type V titanyl phthalocyanine, comprising providing a Type I titanyl phthalocyanine; dissolving the Type I titanyl phthalocyanine in a solution comprising a trihaloacetic acid and an alkylene halide like methylene chloride; adding the resulting mixture comprising the dissolved Type I titanyl phthalocyanine to a solution comprising an alcohol and an alkylene halide thereby precipitating a Type Y titanyl phthalocyanine; and treating the Type Y titanyl phthalocyanine with monochlorobenzene to yield a Type V titanyl phthalocyanine.

A number of the components of the above cross referenced applications, such as the supporting substrates, resin binders, antioxidants, charge transport components, titanyl phthalocyanines, hole blocking layer components, adhesive layers, and the like, may be selected for the photoconductor and imaging members of the present disclosure in embodiments thereof.

BACKGROUND

This disclosure is generally directed to drum and layered imaging members, photoreceptors, photoconductors, and the like. More specifically, the present disclosure is directed to drum, and especially multilayered flexible or belt imaging members or devices comprised of an optional supporting medium like a substrate, a photogenerating layer comprised of, for example, a photogenerating component or components like pigments, such as a titanyl phthalocyanine and a charge transport layer, or a plurality of charge transports layers, such as a first charge transport layer and a second charge transport layer, an optional adhesive layer, an optional hole blocking, or undercoat layer, an optional overcoating layer, and wherein at least one, such as for example from 1 to about 7, from 1 to about 3, and one, of the charge transport layers contains at least one charge transport component, a polymer or resin binder, and an optional antioxidant. Moreover, the charge transport layer can in embodiments contain a silanol; and the photogenerating layer can be comprised of a silanol, a chelating component, such as lactamide, and a high sensitivity titanyl phthalocyanine generated by the processes as illustrated in copending application U.S. application Ser. No. 10/992,500, U.S. Publication No. 20060105254, the disclosures of which are totally incorporated herein by reference. The photoreceptors or photoconductors illustrated herein in embodiments have high photosensitivities, such as in embodiments, greater than a ten percent higher sensitivity than a photoconductor that is free of a chelating agent; resistance to and minimal effects to the photogenerating layer dispersion to solvents; excellent wear and scratch resistance, and extended lifetimes. Additionally, in embodiments the imaging or photoconductive members disclosed herein possess excellent and in a number of instances low $V_r$ (residual potential), and allow the substantial prevention of $V_r$ cycle up when appropriate; high stable sensitivity; low acceptable image ghosting characteristics; and desirable toner cleanability; more rapid transport of holes while maintaining print quality especially in the presence of the temperature variability in close proximity to the photoconductor; substantially maintain development voltage stability; and where the print density is excellent for a number of imaging cycles in a xerographic system. While not being desired to be limited by theory, it is believed that the photogenerating layer chelating agent assists in increasing the sensitivity and stability of the photoconductor and the silanols, permits a lower $V_r$ and minimization or prevention of $V_r$ cycle up.

More specifically, there is illustrated herein in embodiments the incorporation into the photogenerating layer imaging members of suitable high sensitivity photogenerating pigments, such as certain titanyl phthalocyanines, which sensitivity is from about 10 to about 50 percent higher than that of a similar photoconductor containing as the photogenerating pigment hydroxygallium phthalocyanine Type V, and which layer is formed from a dispersion containing the photogenerating pigment, and a number, such as one, of hole transport component layers thereover comprised, for example, of aryl amine hole transport molecules, at least one resin binder, and a silanol, and which layers permit the rapid transport of holes.

Also included within the scope of the present disclosure are methods of imaging and printing with the photoresponsive or photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additives, reference U.S. Pat. Nos. 4,560, 635; 4,298,697 and 4,338,390, the disclosures of which are totally incorporated herein by reference; subsequently transferring the image to a suitable substrate, and permanently affixing the image thereto. In those environments wherein the device is to be used in a printing mode, the imaging method involves the same aforementioned operation with the exception that exposure can be accomplished with a laser device or image bar. More specifically, the imaging members and flexible belts disclosed herein can be selected for the Xerox Corporation iGEN3® machines that generate with some versions over 100 copies per minute. Processes of imaging, especially xerographic imaging and printing, including digital, and/or color printing are thus encompassed by the present disclosure. The imaging members disclosed herein are in embodiments sensitive in the wavelength region of, for example, from about 400 to about 900 nanometers, and in particular from about 650 to about 850 nanometers, thus diode lasers can be selected as the light source. Moreover, the imaging members disclosed herein are in embodiments useful in high resolution color xerographic applications, particularly high-speed color copying and printing processes.

REFERENCES

There is illustrated in U.S. Pat. No. 7,037,631, the disclosure of which is totally incorporated herein by reference, a photoconductive imaging member comprised of a supporting substrate, a hole blocking layer thereover, a crosslinked photogenerating layer and a charge transport layer, and wherein the photogenerating layer is comprised of a photogenerating component and a vinyl chloride, allyl glycidyl ether, hydroxy containing polymer.

In U.S. Pat. No. 4,273,846, the disclosure of which is totally incorporated herein by reference, are disclosed charge transport molecules of amine terphenyl derivatives.

There is illustrated in U.S. Pat. No. 6,913,863, the disclosure of which is totally incorporated herein by reference, a photoconductive imaging member comprised of a hole blocking layer, a photogenerating layer, and a charge transport layer, and wherein the hole blocking layer is comprised of a metal oxide; and a mixture of a phenolic compound and a phenolic resin wherein the phenolic compound contains at least two phenolic groups.

Layered photoresponsive imaging members have been described in numerous U.S. patents, such as U.S. Pat. No. 4,265,990, the disclosure of which is totally incorporated herein by reference, wherein there is illustrated an imaging member comprised of a photogenerating layer, and an aryl amine hole transport layer. Examples of photogenerating layer components include trigonal selenium, metal phthalocyanines, vanadyl phthalocyanines, and metal free phthalocyanines. Additionally, there is described in U.S. Pat. No. 3,121,006, the disclosure of which is totally incorporated herein by reference, a composite xerographic photoconductive member comprised of finely divided particles of a photoconductive inorganic compound dispersed in an electrically insulating organic resin binder.

In U.S. Pat. No. 4,921,769, the disclosure of which is totally incorporated herein by reference, there are illustrated photoconductive imaging members with blocking layers of certain polyurethanes.

Illustrated in U.S. Pat. Nos. 6,255,027; 6,177,219, and 6,156,468, the disclosures of which are totally incorporated herein by reference, are, for example, photoreceptors containing a hole blocking layer of a plurality of light scattering particles dispersed in a binder, reference for example, Example I of U.S. Pat. No. 6,156,468 wherein there is illustrated a hole blocking layer of titanium dioxide dispersed in a specific linear phenolic binder of VARCUM™, available from OxyChem Company.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine.

Illustrated in U.S. Pat. No. 5,482,811, the disclosure of which is totally incorporated herein by reference, is a process for the preparation of hydroxygallium phthalocyanine photogenerating pigments which comprises hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water, concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, in U.S. Pat. No. 5,473,064, the disclosure of which is totally incorporated herein by reference, there is illustrated a process for the preparation of photogenerating pigments of hydroxygallium phthalocyanine Type V essentially free of chlorine, whereby a pigment precursor Type I chlorogallium phthalocyanine is prepared by reaction of gallium chloride in a solvent, such as N-methylpyrrolidone, hydrolyzing said pigment precursor chlorogallium phthalocyanine Type I by standard methods, for example acid pasting, subsequently treating the resulting hydrolyzed pigment hydroxygallium phthalocyanine Type I with a solvent, such as N,N-dimethylformamide, present in an amount of from about 1 volume part to about 50 volume parts, and preferably about 15 volume parts for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and preferably about 24 hours.

Some processes for the preparation of photoreceptors from dispersions may be susceptible to many variables, such as, for example, material variables, including contents and purity of the material; process variables, including milling time and milling procedure; and coating process variables, including web coating, dip coating, the drying process of several layers, and the time interval between the coatings of successive layers, which for example, can cause the electrical characteristics of the resulting photoreceptors to be inconsistent during the manufacturing process.

Sensitivity is a valuable electrical characteristic of electrophotographic imaging members or photoreceptors. Sensitivity may be described in two aspects. The first aspect of sensitivity is spectral sensitivity, which refers to sensitivity as a function of wavelength. An increase in spectral sensitivity implies an appearance of sensitivity at a wavelength in which previously no sensitivity was detected. The second aspect of sensitivity, broadband sensitivity, is a change of sensitivity, for example an increase at a particular wavelength previously exhibiting sensitivity, or a general increase of sensitivity encompassing all wavelengths previously exhibiting sensitivity. This second aspect of sensitivity may also be considered as change of sensitivity, encompassing all wavelengths, with a broadband (white) light exposure. A problem encountered in the manufacturing of photoreceptors is maintaining consistent spectral and broadband sensitivity from batch to batch.

Typically, flexible photoreceptor belts are fabricated by depositing the various layers of photoactive coatings onto long webs that are thereafter cut into sheets. The opposite ends of each photoreceptor sheet are overlapped and ultrasonically welded together to form an imaging belt. In order to increase throughput during the web coating operation, the webs to be coated have a width of twice the width of a final belt. After coating, the web is slit lengthwise, and thereafter, transversely cut into predetermined lengths to form photoreceptor sheets of precise dimensions that are eventually welded into belts. The web length in a coating run may be many thousands of feet long and the coating run may take more than an hour for each layer.

Various types of inorganic photoconductive pigments are known, including pigments based on phthalocyanines. A variety of phthalocyanine based pigments are suitable for use in photoimaging members, including metal-free phthalocyanines, copper, iron, and zinc phthalocyanines, chloroindium phthalocyanines, hydroxygallium phthalocyanines, certain titanium based phthalocyanines, such as, for example, titanyl phthalocyanine Type IV, and compositions comprising combinations of the above pigments. U.S. Pat. No. 6,376,141, the entire disclosure of which is incorporated herein by reference, illustrates various compositions comprising combinations of phthalocyanine pigments including hydroxygallium phthalocyanine pigments. Additionally, for example, U.S. Pat. No. 6,713,220, the disclosure of which is totally incorporated herein by reference, discloses a method of preparing a Type V hydroxygallium phthalocyanine.

A number of titanyl phthalocyanines, or oxytitanium phthalocyanines, may be considered suitable photogenerating pigments known to absorb near infrared light around 800 nanometers. Generally, titanyl phthalocyanine is known to have five main crystal forms known as Types I, II, III, X, and IV. For example, U.S. Pat. Nos. 5,189,155 and 5,189,156, the entire disclosures of which are incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the entire disclosure of which is incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

To obtain a titanyl phthalocyanine-based photoreceptor having high sensitivity to near infrared light, it is believed of value to control not only the purity and chemical structure of the pigment, as is generally the situation with organic photoconductors, but also to prepare the pigment in a certain crystal modification. Consequently, it is still desirable to provide a photoconductor where the titanyl phthalocyanine is generated by a process that will provide high sensitivity titanyl phthalocyanines.

SUMMARY

Figure 1:
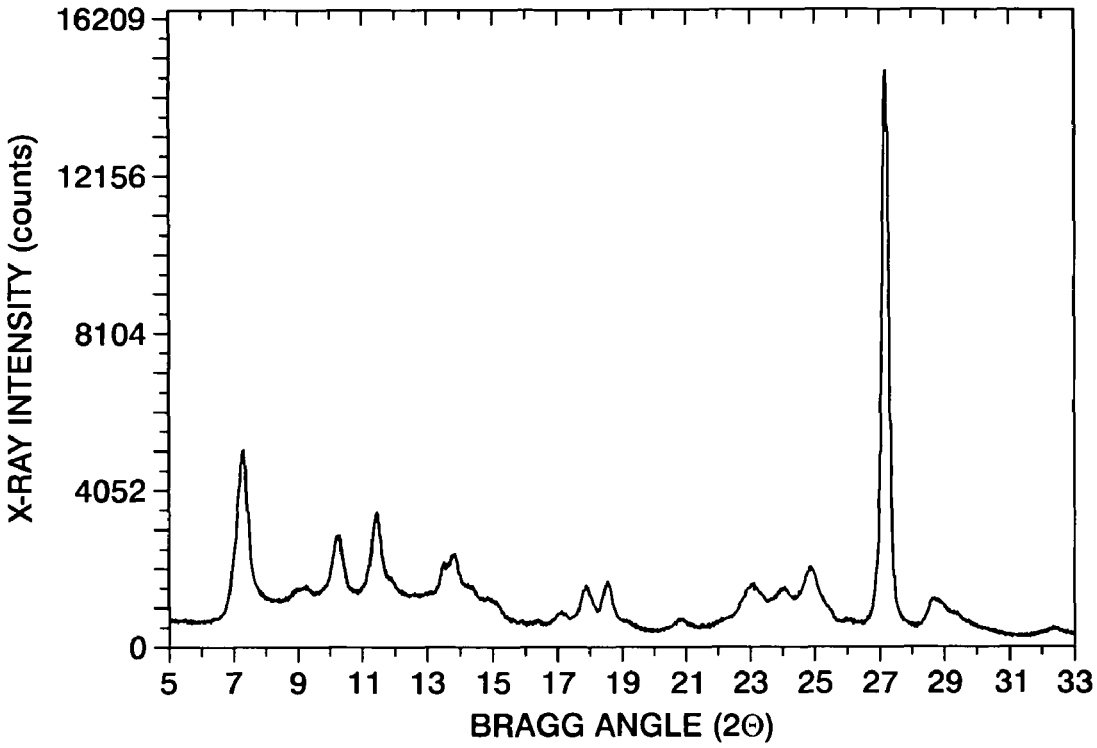
FIG. 1 represents a diffractograph summary of an XRPD of a Type Y titanyl phthalocyanine (TiOPc) with no monchlorobenzene (MCB) conversion.
Figure 2:
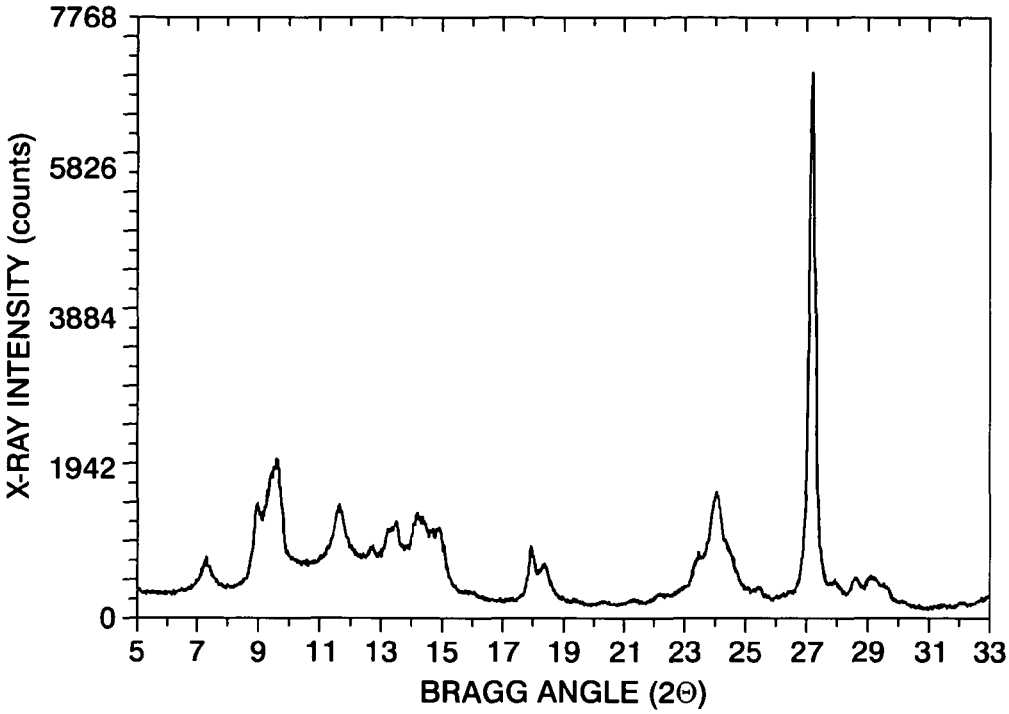
FIG. 2 represents a diffractograph summary of an XRPD of a Type V titanyl phthalocyanine (TiOPc) with a monchlorobenzene (MCB) conversion of about 3 hours.

Disclosed are imaging or photoconductive members with many of the advantages illustrated herein, such as extended lifetimes of service of, for example, in excess of about 3,500,000 imaging cycles; rapid charge transfer to thereby improve print quality caused by temperature variation in proximity to the photoconductor; excellent electrical characteristics, for example high sensitivity; stable electrical properties; low image ghosting; resistance to charge transport layer cracking upon exposure to the vapor of certain solvents; excellent surface characteristics; improved wear resistance; compatibility with a number of toner compositions; the avoidance of or minimal imaging member scratching characteristics; consistent $V_r$ (residual potential) that is substantially flat or no change over a number of imaging cycles as illustrated by the generation of known PIDC (Photoinduced Discharge Curve), and the like.

Also disclosed are layered flexible and drum photoresponsive imaging members, which are responsive to near infrared radiation of from about 700 to about 900 nanometers, and where the layered belt and drum photoresponsive or photoconductive imaging members are mechanically robust and solvent resistant with rapid transport of charge, especially holes; imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000, permitting, for example, a hole blocking layer with excellent efficient electron transport which usually results in a desirable photoconductor low residual potential $V_{low}$, with rapid charge transporting characteristics, high and stable, with a minimum or no PDIC change, photosensitivity, and which sensitivity is in embodiments about 10 to about 30 percent higher than similar photoconductors that are free of a chelating agent in the photogenerating layer.

Embodiments

Aspects of the present disclosure relate to a photoconductor comprising an optional supporting substrate, a photogenerating layer comprised of a chelating agent and a titanyl phthalocyanine, and at least one charge transport layer comprised of at least one charge transport component, and wherein a silanol is present in at least one of said photogenerating layer and said charge transport layer; a photoconductor comprised of a substrate, a photogenerating layer thereover comprised of Type V titanyl phthalocyanine, a silanol, and a chelating component; and a plurality of charge transport layers wherein at least one of the plurality contains at least one hole transport component and a silanol, and wherein at least one charge transport component is of the formula/structure

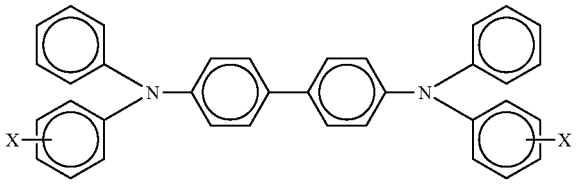

wherein X is alkyl, alkoxy, aryl, or a halogen; a photoconductor containing an optional supporting substrate, a photogenerating layer comprised of a titanyl phthalocyanine, especially Type V titanyl phthalocyanine, and a chelating agent, and at least one charge transport layer comprised of at least one charge transport component, a polymer or resin binder, and wherein a silanol is present in at least one of the photoconductive layers comprising a photogenerating layer and at least one charge transport layer, and wherein the at least one charge transport component is, for example, comprised of aryl amine molecules, and more specifically, wherein the photogenerating layer contains a titanyl phthalocyanine prepared by dissolving a Type I titanyl phthalocyanine in a solution comprising a trihaloacetic acid and an alkylene halide; adding the mixture comprising the dissolved Type I titanyl phthalocyanine to a solution comprising an alcohol, and an alkylene halide thereby precipitating a Type Y titanyl phthalocyanine; and treating the Type Y titanyl phthalocyanine with a monohalobenzene; a photoconductor comprised in sequence of a substrate, a photogenerating layer thereover of a Type V titanyl phthalocyanine, a silanol, and a chelating agent, and a plurality, for example from 1 to about 8 charge transport layers, wherein at least one of the plurality contains a silanol, and hole transport component comprised of amines of the formula

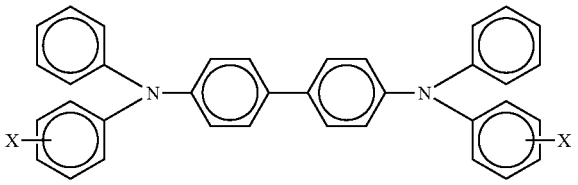

wherein X is a suitable substituent like alkyl, alkoxy, aryl, or a halogen; and/or hole transport molecules of the formula/structure

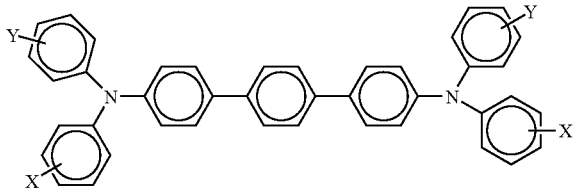

wherein X and Y are independently alkyl, alkoxy, aryl, a halogen, or mixtures thereof; and more specifically, wherein the photogenerating layer contains a titanyl phthalocyanine Type V prepared by dissolving a Type I titanyl phthalocyanine in a solution comprising a trihaloacetic acid and an alkylene halide; adding the mixture to a solution comprising an alcohol and an alkylene halide thereby precipitating a Type Y titanyl phthalocyanine; and contacting the Type Y titanyl phthalocyanine with a monohalobenzene, and optionally wherein the at least one charge transport layer includes an antioxidant; a photoconductor comprised of a substrate, a photogenerating layer comprised of Type V titanyl phthalocyanine, a resin binder, an hydrophobic silanol, and a chelating agent, and a plurality of charge transport layers wherein the plurality comprises at least one charge layer transport comprised of at least one aryl amine component; a photoconductor comprised of a substrate, a photogenerating layer, and wherein the photogenerating layer contains a titanyl phthalocyanine, a polymer or resin binder, a hydrophobic silanol incorporated into the photogenerating layer and a chelating agent, such as lactamide, and wherein the charge transport layer includes a hydrophobic silanol; a photoconductive member with a photogenerating layer of a thickness of from about 0.1 to about 11 microns, at least one transport layer each of a thickness of from about 2 to about 100 microns; a member wherein the photogenerating layer contains the photogenerating pigment present in an amount of from about 30 to about 70 weight percent; a member wherein the thickness of the photogenerating layer is from about 0.1 to about 4 microns; a member wherein the photogenerating layer contains a polymer binder the same as or similar to the charge transport layer binder; a member wherein the photogenerating layer binder is present in an amount of from about 50 to about 90 percent by weight, and wherein the total of all layer components is about 100 percent; a member wherein the photogenerating component is Type V titanyl phthalocyanine that absorbs light of a wavelength of from about 370 to about 950 nanometers; an imaging member wherein the supporting substrate is comprised of a conductive substrate comprised of a metal; an imaging member wherein the conductive substrate is aluminum, aluminized polyethylene terephthalate or titanized polyethylene terephthalate; an imaging member wherein the photogenerating resinous binder is selected from the group consisting of polyesters, polyvinyl butyrals, polyacetals, polycarbonates, polyarylates, polystyrene-b-polyvinyl pyridine, polyvinyl chloride-co-vinyl acetate-co-maleic acid, and polyvinyl formals; a photoconductor containing a photogenerating layer of titanyl phthalocyanine Type V, a suitable chelating component, and a silanol, and at least one, such as two, charge transport layers comprised of a silanol and comprising aryl amine hole transport molecules

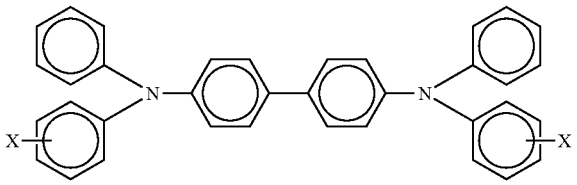

wherein the X substituent, which can be located in the para or meta positions, and also can be located on each of the 4 end rings, is selected from the group consisting of alkyl, alkoxy, substituted alkyl, substituted alkoxy, and halogen; an imaging member wherein alkyl and alkoxy contain from about 1 to about 15 carbon atoms; an imaging member wherein for the aryl amines, alkyl contains from about 1 to about 5 carbon atoms; an imaging member wherein alkyl is methyl; an imaging member wherein each of or at least one of the charge transport layers comprises

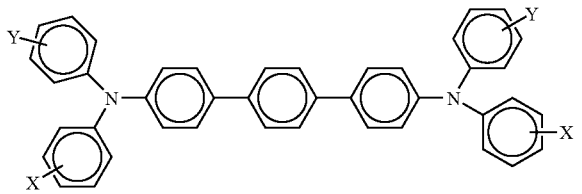

wherein X and Y are independently alkyl, alkoxy, aryl, substituted alkyl, substituted alkoxy, substituted aryl, a halogen such as fluoride, chloride, bromide or iodide, or mixtures thereof; a photoconductive imaging member wherein for each charge transport layer there is selected in a suitable effective amount a terphenyl amine selected from the group consisting of N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, other known terphenyls, and mixtures thereof; a photoconductive imaging member comprised of a supporting substrate, and thereover a layer comprised of titanyl phthalocyanine photogenerating pigment, a silanol, and a suitable chelating agent and a plurality of charge transport layers, and wherein the photogenerating layer is situated between the substrate and the charge transport; a member wherein the charge transport layer is situated between the substrate and the photogenerating layer; a member wherein the photogenerating layer is of a thickness of from about 0.1 to about 50 microns; a member wherein the photogenerating component amount is from about 20 weight percent to about 90 weight percent, and wherein the photogenerating pigment is optionally dispersed in from about 10 weight percent to about 80 weight percent of a polymer binder; a member wherein the thickness of the photogenerating layer is from about 3 to about 10 microns; a member wherein the photogenerating and charge transport layer components are contained in a polymer binder; a member wherein the binder is present in an amount of from about 55 to about 95 percent by weight, and wherein the total of the layer components is about 100 percent; an imaging member with a blocking layer contained as a coating on a substrate, and an adhesive layer coated on the blocking layer; and a color imaging method which comprises generating an electrostatic latent image on the imaging member, developing the latent image, transferring, and fixing the developed electrostatic image to a suitable substrate.

In photoconductor embodiments it is believed that the inclusion of a chelating agent in the photogenerating layer enables increased photosensitivity and stability, while the silanol inclusion in the photogenerating layer and/or at least one charge transport layer assists in permitting a lower $V_r$ and the prevention or minimization of $V_r$ cycle up.

The photogenerating layer in embodiments is comprised of a suitable photogenerating pigment, such as high photosensitivity titanyl phthalocyanines prepared as illustrated herein, and in copending application U.S. application Ser. No. 10/992,500, U.S. Publication No. 2006010524, the disclosures of which are totally incorporated herein by reference. In embodiments, the Type V phthalocyanine can be generated by dissolving Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the resulting Type Y titanyl phthalocyanine with monochlorobenzene.

With further respect to the titanyl phthalocyanines selected for the photogenerating layer, such phthalocyanines exhibit a crystal phase that is distinguishable from other known titanyl phthalocyanine polymorphs, and are designated as Type V polymorphs prepared by converting a Type I titanyl phthalocyanine to a Type V titanyl phthalocyanine pigment. The processes include converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

In one embodiment, the Type V titanyl phthalocyanine process comprises (a) dissolving a Type I titanyl phthalocyanine in a suitable solvent; (b) adding the solvent solution comprising the dissolved Type I titanyl phthalocyanine to a quenching solvent system to precipitate an intermediate titanyl phthalocyanine (designated as a Type Y titanyl phthalocyanine); and (c) treating the resultant Type Y phthalocyanine with a halo, such as, for example, monochlorobenzene to obtain a resultant high sensitivity titanyl phthalocyanine, which is designated herein as a Type V titanyl phthalocyanine. In another embodiment, prior to treating the Type Y phthalocyanine with a halo, such as monochlorobenzene, the Type Y titanyl phthalocyanine may be washed with various solvents including, for example, water, and/or methanol. The quenching solvents system to which the solution comprising the dissolved Type I titanyl phthalocyanine is added comprises, for example, an alkyl alcohol and an alkylene halide. These processes provide a titanyl phthalocyanine having a crystal phase distinguishable from other known titanyl phthalocyanines and is distinguishable from, for example, Type IV titanyl phthalocyanines in that a Type V titanyl phthalocyanine exhibits an X-ray powder diffraction spectrum having four characteristic peaks at 9.0°, 9.6°, 24.0°, and 27.2°, while Type IV titanyl phthalocyanines typically exhibit only three characteristic peaks at 9.6°, 24.0°, and 27.2°. A number of Type I titanyl phthalocyanines may be selected for the generation of the Type V titanyl phthalocyanine, such as the Type 1s prepared as illustrated in U.S. Pat. Nos. 5,153,094; 5,166,339; 5,189,155; and 5,189,156, the disclosures of which are totally incorporated herein by reference. More specifically, a Type I titanyl phthalocyanine may be prepared, in embodiments, by the reaction of $DI^3$ (1,3-diiminoisoindolene) and tetrabutoxide in the presence of 1-chloronaphthalene solvent, whereby there is obtained a crude Type I titanyl phthalocyanine, which is subsequently purified up to about a 99.5 percent purity by washing with, for example, dimethylformamide.

Also, for example, a Type I titanyl phthalocyanine can be prepared by i) the addition of 1 part titanium tetrabutoxide to a stirred solution of from about 1 part to about 10 parts, and in embodiments about 4 parts of 1,3-diiminoisoindolene; ii) relatively slow application of heat using an appropriate sized heating mantle at a rate of about 1° per minute to about 10° per minute and, in embodiments, about 5° per minute until refluxing occurs at a temperature of about 130° C. to about 180° C. (all temperatures are in Centigrade unless otherwise indicated); iii) removal and collection of the resulting distillate, which was shown by NMR spectroscopy to be butyl alcohol, in a dropwise fashion using an appropriate apparatus, such as a Claisen Head condenser, until the temperature of the reactants reaches from 190° C. to about 230° C., and in embodiments, about 200° C.; iv) continued stirring at the reflux temperature for a period of about ½ hour to about 8 hours, and in embodiments, about 2 hours; v) cooling of the reactants to a temperature of about 130° C. to about 180° C., and in embodiments, about 160° C. by removal of the heat source; vi) filtration of the flask contents through, for example, an M-porosity (10 to 15 microns) sintered glass funnel which was preheated using a solvent, which is capable of raising the temperature of the funnel to about 150° C., for example, boiling N,N-dimethylformamide in an amount sufficient to completely cover the bottom of the filter funnel so as to prevent blockage of said funnel; vii) washing the resulting purple solid by slurrying the solid in portions of boiling DMF either in the funnel or in a separate vessel in a ratio of about 1 to about 10, and preferably about 3 times the volume of the solid being washed, until the hot filtrate became light blue in color; viii) cooling and further washing the solid of impurities by slurrying the solid in portions of N,N-dimethylformamide at room temperature, about 25° C., approximately equivalent to about three times blue in color; ix) washing the solid of impurities by slurrying the solid in portions of an organic solvent, such as methanol, acetone, water, and the like, and in this embodiment, methanol, at room temperature (about 25° C.) approximately equivalent to about three times the volume of the solid being washed until the filtrate became light blue in color; x) oven drying the purple solid in the presence of a vacuum or in air at a temperature of from about 25° C. to about 200° C., and, in embodiments at about 70° C., for a period of from about 2 hours to about 48 hours, and in embodiments, for about 24 hours, thereby resulting in the isolation of a shiny purple solid, which was identified as being Type I titanyl phthalocyanine by its X-ray powder diffraction trace.

In still another embodiment, a Type I titanyl phthalocyanine may be prepared by (i) reacting a $DI^3$ with a titanium tetra alkoxide such as, for example, titanium tetrabutoxide at a temperature of about 195° C. for about two hours; (ii) filtering the contents of the reaction to obtain a resulting solid; (iii) washing the solid with dimethylformamide (DMF); (iv) washing with four percent ammonium hydroxide; (v) washing with deionized water; (vi) washing with methanol; (vii) reslurrying the washes and filtering; and (viii) drying at about 70° C. under vacuum to obtain a Type I titanyl phthalocyanine.

In a process embodiment for preparing a high sensitivity phthalocyanine in accordance with the present disclosure, a Type I titanyl phthalocyanine is dissolved in a suitable solvent. In embodiments, a Type I titanyl phthalocyanine is dissolved in a solvent comprising a trihaloacetic acid and an alkylene halide. The alkylene halide comprises, in embodiments, from about one to about six carbon atoms. An example of a suitable trihaloacetic acid includes, but is not limited to, trifluoroacetic acid. In one embodiment, the solvent for dissolving a Type I titanyl phthalocyanine comprises trifluoroacetic acid and methylene chloride. In embodiments, the trihaloacetic acid is present in an amount of from about one volume part to about 100 volume parts of the solvent, and the alkylene halide is present in an amount of from about one volume part to about 100 volume parts of the solvent. In one embodiment, the solvent comprises methylene chloride and trifluoroacetic acid in a volume-to-volume ratio of about 4 to 1. The Type I titanyl phthalocyanine is dissolved in the solvent by stirring for an effective period of time, such as, for example, for about 30 seconds to about 24 hours, at room temperature. The Type I titanyl phthalocyanine is dissolved by, for example, stirring in the solvent for about one hour at room temperature (about 25° C.). The Type I titanyl phthalocyanine may be dissolved in the solvent in either air or in an inert atmosphere (argon or nitrogen).

The Type I titanyl phthalocyanine in embodiments can be converted to an intermediate titanyl phthalocyanine form prior to conversion to the high sensitivity titanyl phthalocyanine pigment. "Intermediate" in embodiments refers, for example, to the preparation of, and optionally the isolation of Type Y titanyl phthalocyanine. For example, to obtain the intermediate form, which is designated as a Type Y titanyl phthalocyanine, the dissolved Type I titanyl phthalocyanine is added to a quenching system comprising an alkyl alcohol, alkyl including, for example, carbon chain lengths of from about 1 to about 12 carbon atoms, and alkylene halides, such as an alkylene chloride. Adding the dissolved Type I titanyl phthalocyanine to the quenching system or quenching mixture causes the Type Y titanyl phthalocyanine to precipitate. Materials suitable as the alkyl alcohol component of the quenching system include, but are not limited to, methanol, ethanol, propanol, butanol, and the like. In embodiments, the alkylene chloride component of the quenching system comprises from about one to about six carbon atoms. In embodiments, the quenching system comprises methanol and methylene chloride. The quenching system comprises an alkyl alcohol to alkylene chloride ratio of from about 1/4 to about 4/1 (v/v). In other embodiments, the ratio of alkyl alcohol to alkylene chloride is from about 1/1 to about 3/1 (v/v). In an embodiment, the quenching system comprises methanol and methylene chloride in a ratio of about 1/1 (v/v). In another embodiment, the quenching system comprises methanol and methylene chloride in a ratio of about 3/1 (v/v). In embodiments, the dissolved Type I titanyl phthalocyanine is added to the quenching system at a rate of from about 1 milliliter/minute to about 100 milliliters/minute, and the quenching system is maintained at a temperature of from about 0° C. to about −25° C. during quenching. In a further embodiment, the quenching system is maintained at a temperature of from about 0° C. to about −25° C. for a period of from about 0.1 hour to about 8 hours after addition of the dissolved Type I titanyl phthalocyanine solution. Following precipitation of the Type Y titanyl phthalocyanine, the precipitates may be washed with any suitable solution, including, for example, methanol, cold deionized water, hot deionized water, and the like. Generally, washing the precipitate will also be accompanied by filtration. A wet cake containing Type Y titanyl phthalocyanine and water is obtained with water content varying from about 30 to about 70 weight percent of the wet cake.

The Type V titanyl phthalocyanine is obtained by treating the obtained intermediate Type Y titanyl phthalocyanine with a halo, such as, for example, monochlorobenzene. The Type Y titanyl phthalocyanine wet cake may be redispersed in monochlorobenzene, filtered and oven-dried at a temperature of from about 60° C. to about 85° C. to provide the resultant Type V titanyl phthalocyanine. The monochlorobenzene treatment may occur over a period of about 1 hour to about 24 hours. In one embodiment, the monochlorobenzene treatment is accomplished for a period of about five hours.

A titanyl phthalocyanine obtained in accordance with processes of the present disclosure, which in embodiments is designated as a Type V titanyl phthalocyanine, exhibits an X-ray powder diffraction spectrum distinguishable from other known titanyl phthalocyanine polymorphs. For example, the Type V titanyl phthalocyanine obtained exhibits in embodiments an X-ray diffraction spectrum having four characteristic peaks at 9.0°, 9.6°, 24.0°, and 27.2°, a particle size diameter of from about 10 nanometers to about 500 nanometers, and which particle size may be controlled or affected by the quenching rate when adding the dissolved Type I titanyl phthalocyanine to the quenching system and the composition of the quenching system.

Generally, the thickness of the photogenerating layer depends on a number of factors, including the thicknesses of the other layers and the amount of photogenerating material contained in the photogenerating layer. Accordingly, this layer in embodiments can be of a thickness of, for example, from about 0.05 micron to about 30 microns, or to about 10 microns, and more specifically, from about 0.25 micron to about 2 microns when, for example, the photogenerating compositions are present in an amount of from about 30 to about 75 percent by volume. The maximum thickness of this layer in embodiments is dependent primarily upon factors, such as photosensitivity, electrical properties and mechanical considerations. The photogenerating layer binder resin includes those polymers as disclosed in U.S. Pat. No. 3,121,006, the disclosure of which is totally incorporated herein by reference, and is present in various suitable amounts, for example from about 1 to about 50 weight percent, and more specifically, from about 1 to about 10 weight percent, and which resin may be selected from a number of known polymers such as poly(vinyl butyral), poly(vinyl carbazole), polyesters, polycarbonates, poly(vinyl chloride), polyacrylates and methacrylates, copolymers of vinyl chloride and vinyl acetate, phenolic resins, polyurethanes, poly(vinyl alcohol), polyacrylonitrile, polystyrene, and the like. It is desirable to select a coating solvent that does not substantially disturb or adversely affect the other previously coated layers of the device. Examples of coating solvents for the photogenerating layer are ketones, alcohols, aromatic hydrocarbons, halogenated aliphatic hydrocarbons, ethers, amines, amides, esters, and the like. Specific examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, dichloroethane, tetrahydrofuran, dioxane, diethyl ether, dimethyl formamide, dimethyl acetamide, butyl acetate, ethyl acetate, methoxyethyl acetate, and the like.

In embodiments the photogenerating layer may contain in addition to the high sensitivity pigments other known photogenerating pigments like metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components such as selenium, selenium alloys, and trigonal selenium.

The chelating agent can be incorporated into the photogenerating layer, in various effective amounts, such as for example, from about 0.05 to about 30, from about 1 to about 20, or from about 2 to about 10 weight percent based on the total amount of the components in the photogenerating layer, and which components include, for example, the photogenerating pigment or pigments, resin binder, chelating agent and suitable additives. Examples of the chelating agents include lactamide, lactic acid, ammonium lactate, salts of lactic acid, glycolamide, glycolic acid, ammonium glycolate, salts of glycolic acid, a number of other suitable known chelating agents, such as those selected for stabilization against hydrolysis, including β-diketones such as acetyl acetone and 2,4-heptanedione, ketoesters such as methyl acetoacetate, ethyl acetoacetate, propyl acetoacetate and butyl acetoacetate, hydroxyl carboxylic acids such as butyric acid, salicylic acid and maleic acid, hydroxyl carboxylic acid esters such as methyl lactate, ethyl salicylate and ethyl maleate, keto alcohols such as 4-hydroxy-4-methyl-2-pentanone, amino alcohols such as triethanolamine, diamides, pyridines, and the like, and the mixtures thereof.

Examples of silanols selected for the photogenerating layer, the charge transport layer or both the photogenerating layer and charge transport layer in various suitable amounts, such as for example, from about 0.1 to about 40, from about 0.5 to about 20, or from 1 to about 10 weight percent, and which silanols can also be referred to as polyhedral oligomeric silsesquioxane (POSS) silanols include

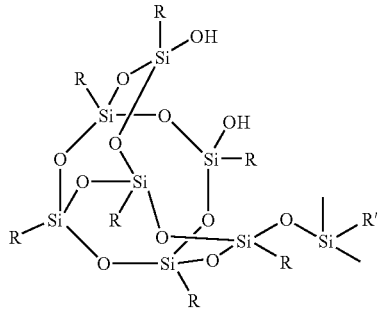

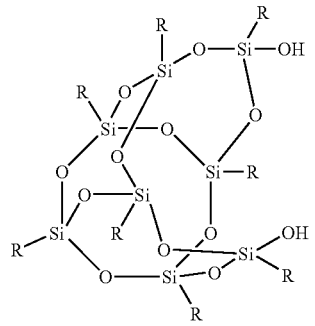

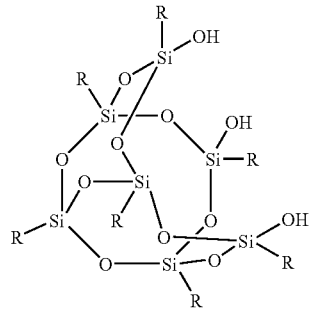

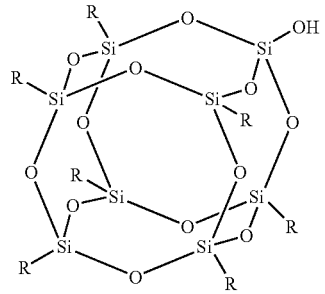

wherein R and R' are independently selected from the group comprised of a suitable hydrocarbon, such as alkyl, alkoxy, aryl, and substituted derivatives thereof, and mixtures thereof with, for example, from 1 to about 36 carbon atoms, like phenyl, methyl, vinyl, allyl, isobutyl, isooctyl, cyclopentyl, cyclohexyl, cyclohexenyl-3-ethyl, epoxycyclohexyl-4-ethyl, fluorinated alkyl such as $CF_3CH_2CH_2$— and $CF_3(CF_2)_5CH_2CH_2$-methacrylolpropyl, norbornenylethyl, and the like.

Examples of POSS silanols, wherein throughout POSS refers to polyhedral oligomeric silsesquioxane silanols, include isobutyl-POSS cyclohexenyldimethylsilyldisilanol or isobutyl-polyhedral oligomeric silsesquioxane cyclohexenyldimethylsilyldisilanol ($C_{38}H_{84}O_{12}Si_8$), cyclopentyl-POSS dimethylphenyldisilanol ($C_{43}H_{76}O_{12}Si_8$), cyclohexyl-POSS dimethylvinyidisilanol ($C_{46}H_{88}O_{12}Si_8$), cyclopentyl-POSS dimethylvinyldisilanol ($C_{39}H_{74}O_{12}Si_8$), isobutyl- POSS dimethylvinyidisilanol ($C_{32}H_{74}O_{12}Si_8$), cyclopentyl-POSS disilanol ($C_{40}H_{74}O_{13}Si_8$), isobutyl-POSS disilanol ($C_{32}H_{74}O_{13}Si_8$), isobutyl-POSS epoxycyclohexyldisilanol ($C_{38}H_{84}O_{13}Si_8$), cyclopentyl-POSS fluoro(3)disilanol ($C_{40}H_{75}F_3O_{12}Si_8$), cyclopentyl-POSS fluoro(13)disilanol ($C_{45}H_{75}F_{13}O_{12}Si_8$), isobutyl-POSS fluoro(13)disilanol ($C_{38}H_{75}F_{13}O_{12}Si_8$), cyclohexyl-POSS methacryldisilanol ($C_{51}H_{96}O_{14}Si_8$), cyclopentyl-POSS methacryldisilanol ($C_{44}H_{82}O_{14}Si_8$), isobutyl-POSS methacryldisilanol ($C_{37}H_{82}O_{14}Si_8$), cyclohexyl-POSS monosilanol ($C_{42}H_{78}O_{13}Si_8$), cyclopentyl-POSS monosilanol (Schwabinol, $C_{35}H_{64}O_{13}Si_8$), isobutyl-POSS monosilanol ($C_{28}H_{64}O_{13}Si_8$), cyclohexyl-POSS norbornenylethyldisilanol ($C_{53}H_{98}O_{12}Si_8$), cyclopentyl-POSS norbornenylethyldisilanol ($C_{46}H_{84}O_{12}Si_8$), isobutyl-POSS norbornenylethyldisilanol ($C_{39}H_{84}O_{12}Si_8$), cyclohexyl-POSS TMS disilanol ($C_{45}H_{88}O_{12}Si_8$), isobutyl-POSS TMS disilanol ($C_{31}H_{74}O_{12}Si_8$), cyclohexyl-POSS trisilanol ($C_{42}H_{80}O_{12}Si_7$), cyclopentyl-POSS trisilanol ($C_{35}H_{66}O_{12}Si_7$), isobutyl-POSS trisilanol ($C_{28}H_{66}O_{12}Si_7$), isooctyl-POSS trisilanol ($C_{56}H_{122}O_{12}Si_7$), phenyl-POSS trisilanol ($C_{42}H_{38}O_{12}Si_7$), and the like, all commercially available from Hybrid Plastics, Fountain Valley, Calif. In embodiments, the desired POSS silanol is a phenyl-POSS trisilanol; and phenyl-polyhedral oligomeric silsesquioxane trisilanol of the following formula/structure

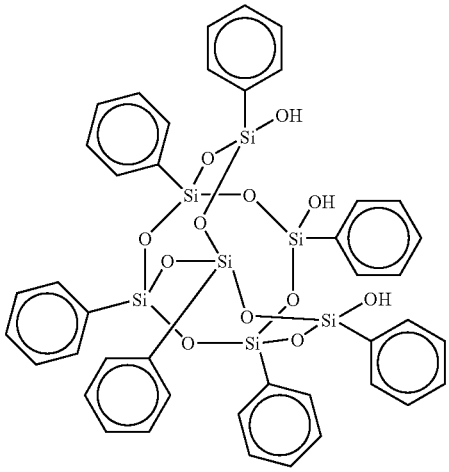

The POSS silanol can contain a number of suitable silicon atoms, such as for example, from about 7 to about 20 silicon atoms, or from about 7 to about 12 silicon atoms. The $M_w$ of the POSS silanol is, for example, from about 700 to about 2,000, or from about 800 to about 1,400.

In embodiments, silanols that can be selected are free of POSS. Examples of such silanols include dimethyl(thien-2-yl)silanol, tris(isopropoxy)silanol, tris(tert-butoxy)silanol, tris(tert-pentoxy)silanol, tris(o-tolyl)silanol, tris(1-naphthyl)silanol, tris(2,4,6-trimethylphenyl)silanol, tris(2-methoxyphenyl)silanol, tris(4-(dimethylamino)phenyl)silanol, tris(4-biphenylyl)silanol, tris(trimethylsilyl)silanol, dicyclohexyltetrasilanol ($C_{12}H_{26}O_5Si_2$), mixtures thereof, and the like.

The silanols selected for the members, devices, and photoconductors illustrated herein are stable primarily in view of the Si—OH substituents in that these substituents eliminate water to form siloxanes that are Si—O—Si linkages. While not to be limited by theory, it is believed that in view of the silanol hindered structures at three bonds attached to the silicon renders them stable for extended time periods, such as from at least one week to over one year.

The thickness of the photoconductor substrate layer is in embodiments dependant on a number of factors, including economical considerations, components in each layer, electrical characteristics, and the like, thus this layer may be of substantial thickness, for example over 3,000 microns, from about 100 to about 1,000 microns, or from about 300 to about 700 microns, or of a minimum thickness. In embodiments, the thickness of this layer is from about 75 microns to about 300 microns, or from about 100 microns to about 150 microns.

The substrate may be opaque or substantially transparent, and may comprise any suitable material inclusive of known materials with suitable mechanical properties. Accordingly, the substrate may comprise a layer of an electrically nonconductive or conductive material such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, as disclosed in a copending application referenced herein, this layer may be of a substantial thickness of, for example, up to many centimeters or of a minimum thickness of less than a millimeter. Similarly, a flexible belt may be of a substantial thickness, for example about 250 micrometers, or of a minimum thickness of less than 50 micrometers, provided there are no adverse effects on the final electrophotographic device.

Illustrative examples of substrates are as illustrated herein, and can comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example, polycarbonate materials commercially available as MAKROLON®.

Various resins can be used as electrically nonconducting materials, including, but not limited to, polyesters, polycarbonates, polyamides, polyurethanes, and the like. Examples of suitable substrate materials include, but are not limited to, a commercially available biaxially oriented polyester known as MYLAR™, available from E.I. DuPont de Nemours & Company, MELINEX™, available from ICI Americas Inc., or HOSTAPHAN™, available from American Hoechst Corporation. Other materials of which the substrate may be comprised include polymeric materials, such as polyvinyl fluoride, available as TEDLAR™ from E.I. DuPont de Nemours & Company, polyethylene and polypropylene, available as MARLEX™ from Phillips Petroleum Company, polyphenylene sulfide, RYTON™, available from Phillips Petroleum Company, and polyimides, available as KAPTON™ from E.I. DuPont de Nemours & Company. The photoreceptor can also be coated on an insulating plastic drum, provided a conducting ground plane has previously been coated on its surface, as described above. Such substrates can either be seamed or seamless.

When a conductive substrate is employed, any suitable conductive material can be selected. For example, the conductive material can include, but is not limited to, metal flakes, powders or fibers, such as aluminum, titanium, nickel, chromium, brass, gold, stainless steel, carbon black, graphite, or the like, in a binder resin including metal oxides, sulfides, suicides, quaternary ammonium salt compositions, conductive polymers, such as polyacetylene or its pyrolysis, and molecular doped products, charge transfer complexes, polyphenyl silane, and molecular doped products from polyphenyl silane. A conducting plastic drum can be used, as well as the preferred conducting metal drum made from a material such as aluminum.

Suitable charge transport components to, for example, allow the transfer of charge, especially holes, include a number of known materials, examples of which are aryl amines of the following formula, and which layer generally is of a thickness of from about 5 microns to about 75 microns, and more specifically, of a thickness of from about 10 microns to about 40 microns,

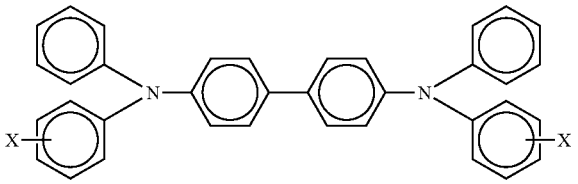

wherein X is at least one of alkyl, alkoxy, aryl, substituted derivatives thereof, and wherein X can also be included on all four benzene end groups, or a halogen, and especially those substituents selected from the group consisting of Cl and $CH_3$; and molecules of the following formula

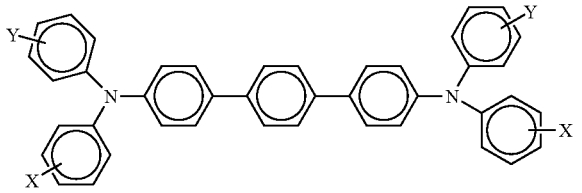

wherein X and Y are independently alkyl, alkoxy, aryl, a halogen, or mixtures thereof. Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide and fluoride. Substituted alkyls, alkoxys, and aryls can also be selected in embodiments.

Examples of specific aryl amines include N,N'-diphenyl-N,N'-bis(alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, and the like, including the corresponding tetraalkyl aryl amines, such as tetramethyl, and wherein X is present on each of the four outer benzene rings. Other known charge transport layer molecules can be selected, reference for example U.S. Pat. Nos. 4,921,773 and 4,464,450, the disclosures of which are totally incorporated herein by reference.

The charge transport layer or layers, and more specifically, a first charge transport in contact with the photogenerating layer, and thereover a top or second charge transport overcoating layer may comprise the illustrated charge transporting small molecules dissolved or molecularly dispersed in a film forming electrically inert polymer such as a polycarbonate. In embodiments, dissolved refers, for example, to forming a solution in which the small molecule is dissolved in the polymer to form a homogeneous phase; and molecularly dispersed in embodiments refers, for example, to charge transporting molecules dispersed in the polymer, the small molecules being dispersed in the polymer on a molecular scale.

Examples of charge transporting molecules include hole transport molecules as indicated herein, and include, for example, known hole transport components; aryl amines such as N,N'-diphenyl-N,N'-bis(3-methylphenyl)-(1,1'-biphenyl)-4,4'-diamine, N,N'-diphenyl-N,N-bis(4-methylphenyl)-1,1'-biphenyl-4,4'-diamine, N,N'-diphenyl-N,N-bis(2-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'-bis(4-butylphenyl)-N,N'-bis-(2,5-dimethylphenyl)-[p-terphenyl]-4,4"-diamine, N,N'-diphenyl-N,N'-bis(3-chlorophenyl)-[p-terphenyl]-4,4"-diamine, optionally mixtures thereof, and the like. In embodiments, to minimize or avoid cycle-up in equipment, such as printers, with high throughput, it is sometimes desirable that the charge transport layer be substantially free (less than about two percent) of di or triamino-triphenyl methane. The electrically active small molecule charge transporting compounds are dissolved or molecularly dispersed in electrically inactive polymeric film forming materials. A small molecule charge transporting compound that permits injection of holes into the photogenerating layer with high efficiency, and transports them across the charge transport layer with short transit times specifically includes N,N'-diphenyl-N,N'-bis(3-methylphenyl)-(1,1'-biphenyl)-4,4'-diamine, N,N'-diphenyl-N,N-bis(4-methylphenyl)-1,1'-biphenyl-4,4'-diamine, N,N'-diphenyl-N,N-bis(2-methylphenyl)-1,1'-biphenyl-4,4'-diamine, N,N'-bis(4-butylphenyl)-N,N'-di-p-tolyl-[p-terphenyl]-4,4"-diamine, N,N'-bis(4-butylphenyl)-N,N'-di-m-tolyl-[p-terphenyl]-4,4"-diamine, N,N'-bis(4-butylphenyl)-N,N'-di-o-tolyl-[p-terphenyl]-4,4"-diamine, N,N'-bis(4-butylphenyl)-N,N'-bis-(4-isopropylphenyl)-[p-terphenyl]-4,4"-diamine, N,N'-bis(4-butylphenyl)-N,N'-bis-(2-ethyl-6-methylphenyl)-[p-terphenyl]-4,4"-diamine, N,N'- bis(4-butylphenyl)-N,N'-bis-(2,5-dimethylphenyl)-[p-terphenyl]-4,4"-diamine, or N,N'-diphenyl-N,N'-bis(3-chlorophenyl)-[p-terphenyl]-4,4"-diamine. When desired, the charge transport material in the charge transport layer may comprise a polymeric charge transport material or a combination of a small molecule charge transport material and a polymeric charge transport material.

The charge transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be maintained from about 2:1 to about 200:1, and in some instances as great as 400:1. The charge transport layer is substantially nonabsorbing to visible light or radiation in the region of intended use, but is electrically "active" in that it allows the injection of photogenerated holes from the photoconductive layer, that is the photogenerating layer, and allows these holes to be transported through itself to selectively discharge a surface charge on the surface of the active layer.

The thickness of the continuous charge transport overcoat layer selected depends, for example, upon the abrasiveness of the charging (bias charging roll), cleaning (blade or web), development (brush), transfer (bias transfer roll), and the like in the system employed, and can be up to about 10 micrometers. In embodiments, this thickness for each layer is from about 1 micrometer to about 5 micrometers. Various suitable and conventional methods may be used to mix, and thereafter apply the overcoat layer coating mixture to the photogenerating layer. Typical application techniques include spraying, dip coating, roll coating, wire wound rod coating, and the like. Drying of the deposited coating may be effected by any suitable conventional technique such as oven drying, infrared radiation drying, air drying, and the like. The dried overcoating layer of this disclosure should transport holes during imaging, and should not have too high a free carrier concentration. Free carrier concentration in the overcoat increases the dark decay.

Examples of the binder materials selected for the charge transport layers include components, such as those described in U.S. Pat. No. 3,121,006, the disclosure of which is totally incorporated herein by reference. Specific examples of polymer binder materials include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof. In embodiments, electrically inactive binders are comprised of polycarbonate resins with, for example, a molecular weight of from about 20,000 to about 100,000, and more specifically, with a molecular weight $M_w$ of from about 50,000 to about 100,000. Examples of polycarbonates are poly(4,4'-isopropylidene-diphenylene) carbonate (also referred to as bisphenol-A-polycarbonate, poly(4,4'-cyclohexylidine diphenylene)carbonate (referred to as bisphenol-Z polycarbonate), poly(4,4'-isopropylidene-3,3'-dimethyldiphenyl)carbonate (also referred to as bisphenol-C-polycarbonate), and the like.

The optional hole blocking or undercoat layer for the imaging members of the present disclosure can contain a number of components, including known hole blocking components, such as amino silanes, doped metal oxides, TiSi, a metal oxide like titanium, chromium, zinc, tin, and the like; a mixture of phenolic compounds and a phenolic resin, or a mixture of two phenolic resins; and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylenediisopropylidene)bisphenol), S (4,4'-sulfonyldiphenol), Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of suitable component like a metal oxide, such as $TiO_2$, from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound preferably containing at least two phenolic groups, such as bisphenol S, and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion, a phenolic compound and dopant are added followed by mixing. The hole blocking layer coating dispersion can be applied by dip coating or web coating, and the layer can be thermally cured after coating. The hole blocking layer resulting is, for example, of a thickness of from about 0.01 micron to about 30 microns, and more specifically, from about 0.1 micron to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical), formaldehyde polymers with ammonia, cresol and phenol, such as VARCUM® 29112 (available from OxyChem Company), formaldehyde polymers with 4,4'-(1-methylethylidene) bisphenol, such as VARCUM™ 29108 and 29116 (available from OxyChem Company), formaldehyde polymers with cresol and phenol, such as VARCUM® 29457 (available from OxyChem Company), DURITE® SD-423A, SD-422A (available from Borden Chemical), or formaldehyde polymers with phenol and p-tert-butylphenol, such as DURITE® ESD 556C (available from Borden Chemical).

The optional hole blocking layer may be applied to the substrate. Any suitable and conventional blocking layer capable of forming an electronic barrier to holes between the adjacent photoconductive layer (or electrophotographic imaging layer) and the underlying conductive surface of the substrate may be selected.

In embodiments, a suitable known adhesive layer, usually situated between the hole blocking layer and the photogenerating layer, can be selected for the photoconductor. Typical adhesive layer materials include, for example, polyesters, polyurethanes, and the like. The adhesive layer thickness can vary, and in embodiments is, for example, from about 0.05 micrometer (500 Angstroms) to about 0.3 micrometer (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying and the like.

As adhesive layer component examples, there can be selected various known substances inclusive of polyesters, copolyesters, polyamides, poly(vinyl butyral), poly(vinyl alcohol), polyurethane, and polyacrylonitrile. This layer is, for example, of a thickness of from about 0.001 micron to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure further desirable electrical and optical properties.

Examples of components or materials optionally incorporated into the charge transport layers or at least one charge transport layer to, for example, enable improved lateral charge migration (LCM) resistance include hindered phenolic antioxidants such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Co., Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Co., Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER® TPS (available from Sumitomo Chemical Co., Ltd.); thioether antioxidants such as SUMILIZER® TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules such as bis(4-diethylamino-2-methylphenyl)phenylmethane (BDETPM), bis-[2-methyl-4-(N-2-hydroxyethyl-N-ethylaminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents and each of the components/compounds/molecules, polymers, (components) for each of the substrate, charge transport, resin binders, hole blocking, and adhesive layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. For example, these substituents include suitable known groups, such as aliphatic and aromatic hydrocarbons with various carbon chain lengths, and which hydrocarbons can be substituted with a number of suitable known groups, and mixtures thereof. Also, the carbon chain lengths are intended to include all numbers between those disclosed or claimed or envisioned, thus from 1 to about 20 carbon atoms, and from 6 to about 42 carbon atoms includes 1, 2, 3, 4, 5, 6, 7, 8, 9, 10, 11, 12, 13, 14, 15 up to 42, or more. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure. These Examples are intended to be illustrative only and are not intended to limit the scope of the present disclosure. Also, parts and percentages are by weight unless otherwise indicated. Comparative Examples and data are also provided.

EXAMPLE I

Preparation of Type I Titanyl Phthalocyanine:

A Type I titanyl phthalocyanine (TiOPc) was prepared as follows. To a 300 milliliter three-necked flask fitted with mechanical stirrer, condenser and thermometer maintained under an argon atmosphere were added 3.6 grams (0.025 mole) of 1,3-diiminoisoindoline, 9.6 grams (0.075 mole) of o-phthalonitrile, 75 milliliters (80 weight percent) of N-methyl pyrrolidone and 7.11 grams (0.025 mole) of titanium tetrapropoxide (all obtained from Aldrich Chemical Company except phthalonitrile, which was obtained from BASF). The resulting mixture (20 weight percent of solids) was stirred and warmed to reflux (about 198° C.) for 2 hours. The resultant black suspension was cooled to about 150° C., and then was filtered by suction through a 350 milliliter, M-porosity sintered glass funnel, which had been preheated with boiling dimethyl formamide (DMF). The solid Type I TiOPc product resulting was washed with two 150 milliliter portions of boiling DMF and the filtrate, initially black, became a light blue-green color. The solid was slurried in the funnel with 150 milliliters of boiling DMF and the suspension was filtered. The resulting solid was washed in the funnel with 150 milliliters of DMF at 25° C., and then with 50 milliliters of methanol. The resultant shiny purple solid was dried at 70° C. overnight to yield 10.9 grams (76 percent) of pigment, which was identified as Type I TiOPc on the basis of its X-ray powder diffraction trace. Elemental analysis of the product indicated C, 66.54; H, 2.60; N, 20.31; and Ash ($TiO_2$), 13.76. TiOPc requires (theory) C, 66.67; H, 2.80; N, 19.44; and Ash, 13.86.

A Type I titanyl phthalocyanine can also be prepared in 1-chloronaphthalene as follows. A 250 milliliter three-necked flask fitted with mechanical stirrer, condenser and thermometer maintained under an atmosphere of argon was charged with 1,3-diiminoisoindolene (14.5 grams), titanium tetrabutoxide (8.5 grams), and 75 milliliters of 1-chloronaphthalene (ClNp). The mixture was stirred and warmed. At 140° C. the mixture turned dark green and began to reflux. At this time the vapor (which was identified as n-butanol by gas chromatography) was allowed to escape to the atmosphere until the reflux temperature reached 200° C. The reaction was maintained at this temperature for two hours then was cooled to 150° C. The product was filtered through a 150 milliliter M-porosity sintered glass funnel, which was preheated to approximately 150° C. with boiling DMF, and then washed thoroughly with three portions of 150 milliliters of boiling DMF, followed by washing with three portions of 150 milliliters of DMF at room temperature, and then three portions of 50 milliliters of methanol, thus providing 10.3 grams (72 percent yield) of a shiny purple pigment, which was identified as Type I TiOPc by X-ray powder diffraction (XRPD).

EXAMPLE II

Preparation of Type V Titanyl Phthalocyanine:

Fifty grams of TiOPc Type I were dissolved in 300 milliliters of a trifluoroacetic acid/methylene chloride (1/4, volume/volume) mixture for 1 hour in a 500 milliliter Erlenmeyer flask with magnetic stirrer. At the same time, 2,600 milliliters of methanol/methylene chloride (1/1, volume/volume) quenching mixture was cooled with a dry ice bath for 1 hour in a 3,000 milliliter beaker with magnetic stirrer, and the final temperature of the mixture was about −25° C. The resulting TiOPc solution was transferred to a 500 milliliter addition funnel with a pressure-equalization arm, and added into the cold quenching mixture over a period of 30 minutes. The mixture obtained was then allowed to stir for an additional 30 minutes, and subsequently hose-vacuum filtered through a 2,000 milliliter Buchner funnel with fibrous glass frit of 4 to 8 μm in porosity. The pigment resulting was then well mixed with 1,500 milliliters of methanol in the funnel, and vacuum filtered. The pigment was then well mixed with 1,000 milliliters of hot water (>90° C.), and vacuum filtered in the funnel four times. The pigment was then well mixed with 1,500 milliliters of cold water, and vacuum filtered in the funnel. The final water filtrate was measured for conductivity, which was below 10 μS. The resulting wet cake contained approximately 50 weight percent of water. A small portion of the wet cake was dried at 65° C. under vacuum and a blue pigment was obtained. A representative XRPD of this pigment after quenching with methanol/methylene chloride was identified by XRPD as Type Y titanyl phthalocyanine.

The remaining portion of the wet cake was redispersed in 700 grams of monochlorobenzene (MCB) in a 1,000 milliliter bottle and rolled for an hour. The dispersion was vacuum filtered through a 2,000 milliliter Buchner funnel with a fibrous glass frit of 4 to 8 μm in porosity over a period of two hours. The pigment was then well mixed with 1,500 milliliters of methanol and filtered in the funnel twice. The final pigment was vacuum dried at 60° C. to 65° C. for two days. Approximately 45 grams of the pigment were obtained. The XRPD of the resulting pigment after the MCB conversion is designated as a Type V titanyl phthalocyanine. The Type V had an X-ray diffraction pattern having characteristic diffraction peaks at a Bragg angle of 2Θ±0.2° at about 9.0°, 9.6°, 24.0°, and 27.2°.

COMPARATIVE EXAMPLE 1

Preparation of Type IV Titanyl Phthalocyanine:

Five hundred grams of TiOPc Type I were dissolved in 5 liters of a 1/4 (volume/volume) mixture of trifluoroacetic acid and methylene chloride over a period of approximately 15 minutes. A 1/1 (v/v) methanol/water mixture (50 liters), which had been cooled overnight to about 0° C., was divided into three equal portions and placed in three plastic 5 gallon pails. The dissolved pigment solution was also divided into three equal portions, and added dropwise to the chilled methanol/water over a period of 1 hour. The precipitated solid clung to the sides of the pails allowing for removal of the solvents by simple decantation. The solid was then redispersed in methanol (50 liters), and filtered through a Buchner Funnel (600 centimeters diameter) fitted with a glass fiber filter paper, and then washed with approximately 50 liters of hot water (60° C. to 80° C.). The wet cake was then redispersed in monochlorobenzene (50 liters) and filtered as before. The washed pigment obtained was then oven dried at 70° C. overnight (about 18 to 20 hours) to afford 455 grams (91 percent yield) of a powdery blue pigment, which was identified as Type IV titanyl phthalocyanine by XRPD. The Type Iv had an X-ray diffraction pattern having characteristic diffraction peaks at a Bragg angle 2Θ±0.2° at about 9.6°, 24.0°, and 27.2°.

The Type V TiOPc pigment prepared by a process according to the present disclosure generated four characteristic peaks at 9.0°, 9.6° 24.0°, and 27.2°, and was distinguishable from the Type IV TiOPc pigment.

TEM and SEM micrographs of a Type V TiOPc prepared by the process of Example II, and an SEM micrograph of a Type fV TiOPc prepared according to Comparative Example 1 were generated. The Type V TiOPc of Example II exhibited a surface area of about 40 $m^2$/grams as compared to 20 $m^2$/grams for the TiOPc of Comparative Example 1.

COMPARATIVE EXAMPLE 2

An imaging member was prepared by providing a 0.02 micrometer thick titanium layer coated on a biaxially oriented polyethylene naphthalate substrate (KALEDEX™ 2000) having a thickness of 3.5 mils, and applying thereon, with a gravure applicator, a solution containing 50 grams of 3-amino-propyltriethoxysilane, 41.2 grams of water, 15 grams of acetic acid, 684.8 grams of denatured alcohol and 200 grams of heptane. This layer was then dried for about 5 minutes at 135° C. in the forced air dryer of the coater. The resulting blocking layer had a dry thickness of 500 Angstroms. An adhesive layer was then prepared by applying a wet coating over the blocking layer, using a gravure applicator, and which adhesive contains 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 gram of the known polycarbonate LUPILON 200™ (PCZ-200) or Polycarbonate Z, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (HOGaPc, Type V) and 300 grams of ⅛ inch (3.2 millimeter) diameter stainless steel shot. This mixture was then placed on a ball mill for 8 hours. Subsequently, 2.25 grams of PCZ-200 was dissolved in 46.1 grams of tetrahydrofuran, and added to the hydroxygallium phthalocyanine dispersion. This slurry was then placed on a shaker for 10 minutes. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micrometer.

This imaging member web was then overcoated with a two-layer charge transport layer. Specifically, the photogenerating layer was overcoated with a charge transport layer (the bottom layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the photogenerating layer to form a coating of the bottom layer that upon drying (120° C. for 1 minute) had a thickness of 14.5 microns. During this coating process the humidity was equal to or less than 15 percent.

The bottom layer of the charge transport layer was overcoated with a top layer. The charge transport layer solution of the top layer was prepared as described above for the bottom layer. This solution was applied on the bottom layer of the charge transport layer to form a coating that upon drying (120° C. for 1 minute) had a thickness of 14.5 microns. During this coating process, the humidity was equal to or less than 15 percent.

EXAMPLE III

An imaging member or photoconductor was prepared by repeating the process of Comparative Example 2 except that the photogenerating layer dispersion was prepared by milling 1.65 grams of the known polycarbonate LUPILON 200™ (PCZ-200) or Polycarbonate Z, weight average molecular weight of 20,000, available from Mitsubishi Gas Chemical Corporation, 1.65 grams of titanyl phthalocyanine Type V of Example II, 0.066 grams of lactamide, 56.7 grams of monochlorobenzene (MCB), and 150 grams of GlenMills glass beads (1 to 1.25 millimeters in diameter) together via attritor for 1.5 hours. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micrometer.

EXAMPLE IV

An imaging member was prepared by repeating the process of Comparative Example 2 except that the photogenerating layer dispersion was prepared by milling 1.65 grams of the known polycarbonate LUPILON 200™ (PCZ-200) or Polycarbonate Z, weight average molecular weight of 20,000, available from Mitsubishi Gas Chemical Corporation, 1.65 grams of titanyl phthalocyanine Type V of Example II, 0.165 grams of the silanol phenyl-POSS trisilanol (SO1458™, available from Hybrid Plastics, Fountain Valley, Calif.), 0.066 grams of lactamide, 56.7 grams of monochlorobenzene (MCB), and 150 grams of GlenMills glass beads (1 to 1.25 millimeters in diameter) together via attritor for 1.5 hours. The resulting dispersion was, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer was deliberately left uncoated by any of the photogenerating layer material to facilitate adequate electrical contact by the ground strip layer that was applied later. The photogenerating layer was dried at 120° C. for 1 minute in a forced air oven to form a dry photogenerating layer having a thickness of 0.4 micrometer.

EXAMPLE V

An imaging member was prepared by repeating the process of Example III except that the top layer of the charge transport layer was prepared by introducing into an amber glass bottle in a weight ratio of 1:1:0.08 N,N'-diphenyl-N,N'-bis(3-methylphenyl)-1,1'-biphenyl-4,4'-diamine, MAKROLON® 5705, a polycarbonate resin having an $M_w$ molecular weight of from about 50,000 to about 100,000, commercially available from Farbenfabriken Bayer A.G, and the silanol phenyl-POSS trisilanol (SO1458™, available from Hybrid Plastics, Fountain Valley, Calif.). The resulting mixture was dissolved in methylene chloride to form a solution containing 15 percent by weight solids.

EXAMPLE VI

An imaging member is prepared by repeating the process of Comparative Example 2 except that the photogenerating layer dispersion is prepared by milling 1.65 grams of the known polycarbonate LUPILON 200™ (PCZ-200) or Polycarbonate Z, weight average molecular weight of 20,000, available from Mitsubishi Gas Chemical Corporation, 1.65 grams of titanyl phthalocyanine Type V of Example II, 0.132 grams of ethyl acetoacetate, 56.7 grams of monochlorobenzene (MCB), and 150 grams of GlenMills glass beads (1 to 1.25 millimeters in diameter) together via attritor for 1.5 hours. The resulting dispersion is, thereafter, applied to the above adhesive interface with a Bird applicator to form a photogenerating layer having a wet thickness of 0.25 mil. A strip about 10 millimeters wide along one edge of the substrate web bearing the blocking layer, and the adhesive layer is deliberately left uncoated by any of the photogenerating layer material to facilitate adequate electrical contact by the ground strip layer that is applied later. The photogenerating layer is dried at 120° C. for 1 minute in a forced air oven to form a dry photogenerating layer having a thickness of 0.4 micrometer.

EXAMPLE VII

An imaging member is prepared by repeating the process of Comparative Example 2 except that the photogenerating layer dispersion is prepared by milling 1.65 grams of the known polycarbonate LUPILON 200™ (PCZ-200) or Polycarbonate Z, weight average molecular weight of 20,000, available from Mitsubishi Gas Chemical Corporation, 1.65 grams of titanyl phthalocyanine Type V of Example II, 0.33 grams of the silanol phenyl-POSS trisilanol (SO1458™, available from Hybrid Plastics, Fountain Valley, Calif.), 0.132 grams of ethyl acetoacetate, 56.7 grams of monochlorobenzene (MCB), and 150 grams of GlenMills glass beads (1 to 1.25 millimeters in diameter) together via attritor for 1.5 hours. The resulting dispersion is, thereafter, applied to the above adhesive interface with a Bird applicator to form a photogenerating layer having a wet thickness of 0.25 mil. A strip about 10 millimeters wide along one edge of the substrate web bearing the blocking layer and the adhesive layer is deliberately left uncoated by any of the photogenerating layer material to facilitate adequate electrical contact by the ground strip layer that is applied later. The photogenerating layer is dried at 120° C. for 1 minute in a forced air oven to form a dry photogenerating layer having a thickness of 0.4 micrometer.

EXAMPLE VIII

An imaging member is prepared by repeating the process of Example VI except that the bottom layer of the charge transport layer is prepared by introducing into an amber glass bottle in a weight ratio of 1:1:0.16 N,N'-diphenyl-N,N'-bis(3-methylphenyl)-1,1'-biphenyl-4,4'-diamine, MAKROLON® 5705, a polycarbonate resin having a molecular weight of from about 50,000 to about 100,000, commercially available from Farbenfabriken Bayer A.G, and the silanol phenyl-POSS trisilanol (SO1458™, available from Hybrid Plastics, Fountain Valley, Calif.). The resulting mixture is dissolved in methylene chloride to form a solution containing 15 percent by weight solids.

Electrical Property Testing

Four of the above prepared photoreceptor devices (Comparative Example 2 and Examples III, IV, V) were tested in a scanner set to obtain photoinduced discharge cycles, sequenced at one charge-erase cycle followed by one charge-expose-erase cycle wherein the light intensity was incrementally increased with cycling to produce a series of photoinduced discharge characteristic curves from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The devices were tested at surface potentials of 500 volts with the exposure light intensity incrementally increased by means of regulating a series of neutral density filters; the exposure light source is a 780 nanometer light emitting diode. The xerographic simulation was completed in an environmentally controlled light tight chamber at ambient conditions (40 percent relative humidity and 22° C.). The results are summarized in the following.

| | Sensitivity ($Vcm^2/erg$) | $V_r$ (V) |
|---|---|---|
| Comparative Example 2 | −320 | 40 |
| Example III | −450 | 42 |
| Example IV | −455 | 25 |
| Example V | −453 | 12 |

Sensitivity is measured as the initial slope of a photoinduced discharge characteristic (PDIC) curve, while $V_r$ is the residual potential after erase. The high sensitivity TiOPc (Type V) device (Example III) exhibited about a 30 percent higher sensitivity than that of HOGaPc (Type V) device (Comparative Example 2), while the $V_r$ is similar. Incorporation of the hydrophobic silanol into either the high-sensitivity TiOPc photogenerating layer (Example IV) or charge transport layer (Example V) did not increase the photosensitivity further, but reduced the $V_r$. Furthermore, there was almost no $V_r$ cycle up for Examples IV and V due to the incorporation of the hydrophobic silanol into either the photogenerating layer or charge transport layer.

In embodiments, there is disclosed a number of improved characteristics for the photoconductive members as determined by the generation of known PIDC curves, such as minimization or prevention of $V_r$ (residual potential) cycle up by the physical doping of the silanol like phenyl-POSS trisilanol in the charge transport layer, photogenerating layer, or both layers. Incorporation of phenyl-POSS trisilanol in the high sensitivity TiOPc (Type V) photogenerating layer (Example VII), the bottom charge transport layer (Example VIII) does not further increase the sensitivity, however, lowers the residual potential, and eliminates or minimizes the residual potential cycle up.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising a photogenerating layer comprised of a chelating agent and a titanyl phthalocyanine, and at least one charge transport layer comprised of at least one charge transport component, and wherein a silanol is present in at least one of said photogenerating layer and said charge transport layer, and wherein said silanol is of the formulas/structures

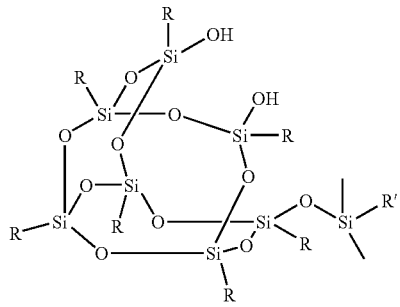

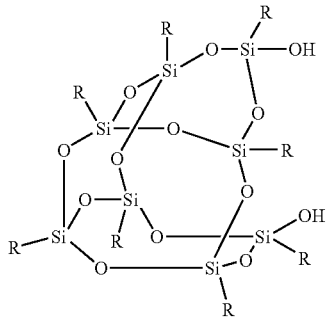

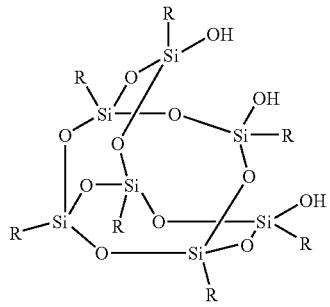

and

-continued

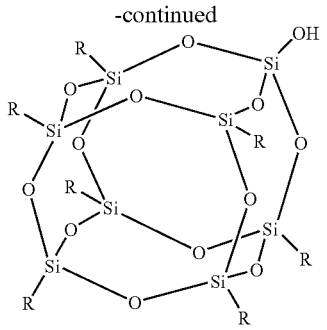

wherein each R and R' is independently alkyl, alkoxy, or aryl.

2. A photoconductor in accordance with claim 1 wherein said titanyl phthalocyanine is prepared by dissolving a Type I titanyl phthalocyanine in a solution comprising a trihaloacetic acid and an alkylene halide; adding said mixture comprising the dissolved Type I titanyl phthalocyanine to a solution comprising an alcohol and an alkylene halide thereby precipitating a Type Y titanyl phthalocyanine; and treating said Type Y titanyl phthalocyanine with a monohalobenzene; and wherein said photoconductor includes a supporting substrate in contact with said photogenerating layer.

3. A photoconductor in accordance with claim 2 wherein said solution comprising an alcohol and an alkylene halide has an alcohol to alkylene halide ratio of from about 1/4 (v/v) to about 4/1 (v/v), and said titanyl phthalocyanine is Type V titanyl phthalocyanine, and wherein the resulting Type V titanyl phthalocyanine has an X-ray diffraction pattern having characteristic diffraction peaks at a Bragg angle 2Θ±0.2° at about 9.0°, 9.6°, 24.0°, and 27.2°.

4. A photoconductor in accordance with claim 2 wherein said monohalobenzene is monochlorobenzene, and wherein said solution comprising an alcohol and an alkylene halide comprises methanol and methylene chloride.

5. A photoconductor in accordance with claim 1 wherein said titanyl phthalocyanine is prepared by dissolving a Type I titanyl phthalocyanine in a solution of trifluoroacetic acid and methylene chloride; precipitating a Type Y titanyl phthalocyanine by adding said solution of trifluoroacetic acid, methylene chloride and the Type I titanyl phthalocyanine to a solution of methanol and methylene chloride; washing said Type Y titanyl phthalocyanine; and converting the Type Y titanyl phthalocyanine to a Type V titanyl phthalocyanine by treating said Type Y titanyl phthalocyanine with monochlorobenzene; and wherein said photoconductor includes a supporting substrate in contact with said photogenerating layer.

6. A photoconductor in accordance with claim 1 wherein said phthalocyanine is Type V titanyl phthalocyanine prepared by dissolving a Type I titanyl phthalocyanine pigment in a solution comprising a trihaloacetic acid and an alkylene chloride; quenching the resultant solution in a quenching mixture comprising an alcohol and an alkylene halide to precipitate an intermediate titanyl phthalocyanine pigment; and treating said intermediate titanyl phthalocyanine with monochlorobenzene.

7. A photoconductor in accordance with claim 1 wherein said chelating agent is present in an amount of from about 0.05 to about 30 weight percent; and wherein said photoconductor includes a supporting substrate in contact with said photogenerating layer.

8. A photoconductor in accordance with claim 1 wherein said chelating agent is present in an amount of from about 1 to about 20 weight percent.

9. A photoconductor in accordance with claim 1 wherein said chelating agent is at least one of a β-diketone, a ketoester, a hydroxyl carboxylic acid, a hydroxyl carboxylic acid ester, a hydroxyl carboxylic acid salt, a hydroxyl carboxylic acid amide, a keto alcohol, an amino alcohol, a diamide, and a pyridine.

10. A photoconductor in accordance with claim 1 wherein said chelating agent is selected from the group consisting of at least one lactamide, lactic acid, salts of lactic acid, glycolamide, glycolic acid, salts of glycolic acid, acetyl acetone, 2,4-heptanedione, methyl acetoacetate, ethyl acetoacetate, propyl acetoacetate, butyl acetoacetate, butyric acid, salicylic acid, maleic acid, methyl lactate, ethyl salicylate, ethyl maleate, 4-hydroxy-4-methyl-2-pentanone, triethanolamine, oxamide, and succinamide.

11. A photoconductor in accordance with claim 1 wherein said photogenerating layer is comprised of said titanyl phthalocyanine, a binder, said silanol, and said chelating agent selected from the group consisting of at least one of lactamide, lactic acid, salts of lactic acid, glycolamide, glycolic acid, salts of glycolic acid, acetyl acetone, 2,4-heptanedione, methyl acetoacetate, ethyl acetoacetate, propyl acetoacetate, butyl acetoacetate, butyric acid, salicylic acid, maleic acid, methyl lactate, ethyl salicylate, ethyl maleate, 4-hydroxy-4-methyl-2-pentanone, triethanolamine, oxamide, and succinamide, and wherein said charge transport layer is comprised of hole transport molecules and a resin binder, wherein at least one is from 1 to about 4; and wherein said photoconductor includes a supporting substrate in contact with said photogenerating layer.

12. A photoconductor in accordance with claim 1 wherein said charge transport component is comprised of at least one aryl amine of the formula/structure

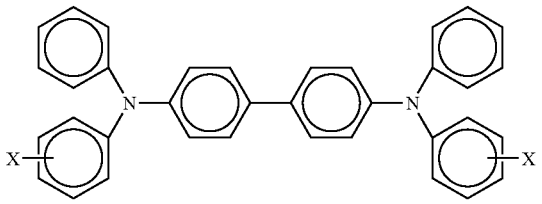

wherein X is at least one of alkyl, alkoxy, aryl, and a halogen; and wherein said photoconductor includes a supporting substrate in contact with said photogenerating layer.

13. A photoconductor in accordance with claim 12 wherein said aryl amine is selected from the group consisting of N,N'-diphenyl-N,N-bis (3-methylphenyl)-1,1'-biphenyl-4,4'-diamine, N,N'-diphenyl-N,N-bis(4-methylphenyl)-1,1'-biphenyl-4,4'-diamine, and N,N'-diphenyl-N,N-bis(2-methylphenyl)-1,1'-biphenyl-4,4'-diamine.

14. A photoconductor in accordance with claim 1 further including in at least one of said charge transport layers an antioxidant comprised of at least one of a hindered phenolic and a hindered amine.

15. A photoconductor in accordance with claim 1 further including a hole blocking layer, and an adhesive layer.

16. A photoconductor in accordance with claim 1 wherein said silanol is present in an amount of from about 0.01 to about 30 weight percent of the charge transport layer components, and from about 0.1 to about 40 weight percent of the photogenerating layer components.

17. A photoconductor in accordance with claim 1 wherein said photoconductor includes a supporting substrate in contact with said photogenerating layer, said photogenerating layer is situated between said at least one charge transport layer and said substrate, said at least one charge transport layer is from 1 to about 3, said silanol and said chelating agent are each present in an amount of from about 0.5 to about 10 weight percent, said photogenerating layer and said charge transport layer each contains a resin binder, and wherein the photoconductor further includes a hole blocking layer, and an adhesive layer situated between said substrate and said photogenerating layer, and wherein at least one charge transport layer further contains a silanol.

18. A photoconductor in accordance with claim 1 wherein said at least one charge transport layer is from 1 to about 7 layers;

and wherein said photoconductor includes a supporting substrate in contact with said photogenerating layer.

19. A photoconductor in accordance with claim 1 wherein said at least one charge transport layer is from 1 to about 3 layers;

and wherein said photoconductor includes a supporting substrate in contact with said photogenerating layer.

20. A photoconductor in accordance with claim 1 wherein said at least one charge transport layer is comprised of a top charge transport layer and a bottom charge transport layer, and wherein said top layer is in contact with said bottom layer and said bottom layer is in contact with said photogenerating layer.

21. A photoconductor in accordance with claim 20 wherein said top layer is comprised of at least one charge transport component, a resin binder, a silanol, and an optional antioxidant, and said bottom layer is comprised of at least one charge transport component, a silanol, a resin binder, and an antioxidant.

22. A photoconductor comprised of a substrate, a photogenerating layer thereover comprised of a photogenerating component, a silanol, and a chelating component, and at least one hole transport layer; and wherein said hole charge transport component is of the formula/structure

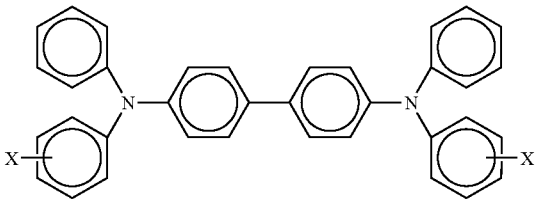

wherein X is at least one of alkyl, alkoxy, aryl, and a halogen; and which hole transport contains a silanol represented by the formulas/structures

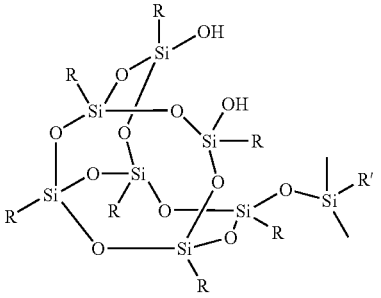

-continued

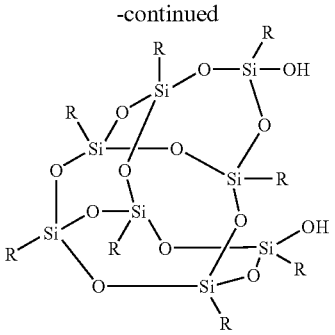

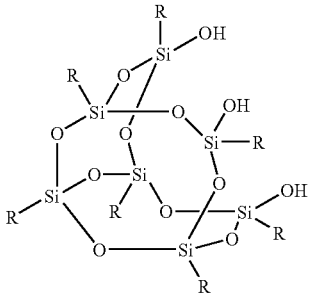

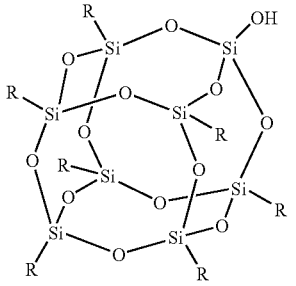

wherein each R and R' is independently alkyl, alkoxy, or aryl.

23. A photoconductor in accordance with claim 22 wherein said photogenerating component is a titanyl phthalocyanine Type V prepared by dissolving a Type I titanyl phthalocyanine in a solution comprising a trihaloacetic acid and an alkylene halide; adding said mixture to a solution comprising an alcohol and an alkylene halide thereby precipitating a Type Y titanyl phthalocyanine; and contacting said Type Y titanyl phthalocyanine with a monohalobenzene; and wherein said X is present on the four terminal rings.

24. A photoconductor comprised of a substrate, a photogenerating layer, and at least one charge transport layer, and wherein said photogenerating layer contains a titanyl phthalocyanine pigment, a silanol, and a chelating agent; and wherein said charge transport layer is comprised of hole transport molecules, and wherein at least one is from 1 to about 4, and wherein said silanol is of the formulas/structures

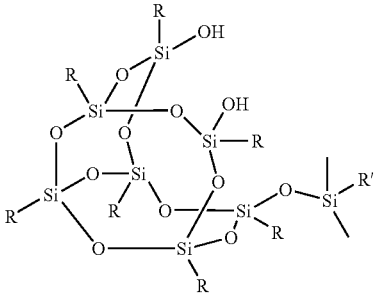

-continued

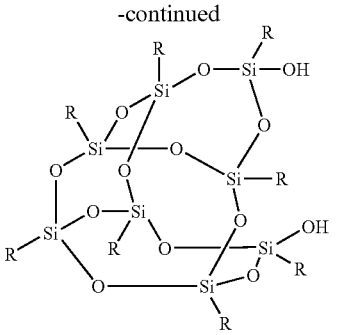

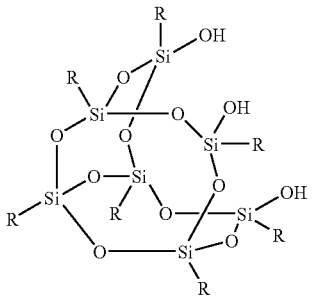

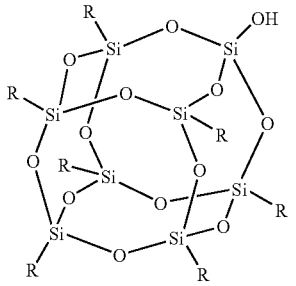

wherein each R and R' is independently alkyl, alkoxy, aryl, or substituted derivatives thereof.

25. A photoconductor in accordance with claim 24 wherein said titanyl phthalocyanine is present in an amount of from about 20 to about 80 weight percent in the photogenerating layer; said silanol and said chelating agent are each present in an amount of from about 0.5 to about 20 weight percent; and wherein said hole transport molecules are present in an amount of from about 30 to about 70 weight percent in the at least one charge transport layer.

26. A photoconductor in accordance with claim 24 wherein said titanyl phthalocyanine is Type V possessing diffraction peaks at Bragg angle 2Θ±0.2° at about 9.0°, 9.6°, 24.0°, and 27.2°.

27. A photoconductor in accordance with claim 24 wherein said chelating agent is present in an amount of from about 0.5 to about 20 weight percent, and said silanol is present in an amount of from about 1 to about 15 weight percent.

28. A photoconductor in accordance with claim 24 wherein said chelating agent is at least one of β-diketones, ketoesters, hydroxyl carboxylic acids, hydroxyl carboxylic acid esters, hydroxyl carboxylic acid salts, hydroxyl carboxylic acid amides, keto alcohols, amino alcohols, diamides, and pyridines.

29. A photoconductor in accordance with claim 24 wherein said photogenerating layer further contains a polycarbonate resin binder, and said charge transport layer contains a polycarbonate resin binder, and further contains a silanol; said substrate is comprised of an insulating or conducting material; said photogenerating layer is situated between said charge transport layer and said substrate; said chelating agent is a lactamide present in an amount of from about 1 to about 10 weight percent; and said photogenerating layer is formed from a dispersion of said titanyl phthalocyanine, said polycarbonate, said silanol, and said chelating agent.

30. A photoconductor in accordance with claim 24 wherein said chelating agent is selected from a group consisting of at least one of lactamide, lactic acid, salts of lactic acid, glycolamide, glycolic acid, salts of glycolic acid, acetyl acetone, 2,4-heptanedione, methyl acetoacetate, ethyl acetoacetate, propyl acetoacetate, butyl acetoacetate, butyric acid, salicylic acid, maleic acid, methyl lactate, ethyl salicylate, ethyl maleate, 4-hydroxy-4-methyl-2-pentanone, triethanolamine, oxamide, and succinamide.

31. A photoconductor in accordance with claim 24 wherein said R and R' are alkyl.

32. A photoconductor in accordance with claim 24 wherein said alkyl and alkoxy each contain from 1 to about 18 carbon atoms, and said aryl contains from 6 to about 42 carbon atoms, wherein each of said photogenerating layer and charge transport layer contain a resin binder; and wherein said photogenerating layer contains at least one photogenerating pigment; and said charge transport layer comprises hole transport molecules.

* * * * *